US006939843B2

(12) United States Patent
Kvita et al.

(10) Patent No.: US 6,939,843 B2
(45) **Date of Patent: *Sep. 6, 2005**

(54) FABRIC SOFTENER COMPOSITIONS

(75) Inventors: Petr Kvita, Reinach (CH); Peter Otto, Rheinfelden (DE); Mario Dubini, Niederdorf (CH); Harald Chrobaczek, Augsburg (DE); Michael Geubtner, Langweid (DE); Ralf Goretzki, Stadtbergen (DE); Barbara Weber, Grenzach-Wyhlen (DE); Emmanuel Martin, Saint Louis Neuweg (FR)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/916,927

(22) Filed: Aug. 12, 2004

(65) Prior Publication Data

US 2005/0020477 A1 Jan. 27, 2005

Related U.S. Application Data

(62) Division of application No. 10/089,852, filed as application No. PCT/EP00/09396 on Sep. 26, 2000, now Pat. No. 6,831,055.

(30) Foreign Application Priority Data

Oct. 5, 1999 (EP) ..... 99810899

(51) Int. Cl.[7] ..... C11D 3/37; C11D 1/825
(52) U.S. Cl. ..... 510/516; 510/527
(58) Field of Search ..... 510/516, 520, 510/522, 527

(56) References Cited

U.S. PATENT DOCUMENTS

| | | | | | |
|---|---|---|---|---|---|
| 4,448,699 | A | * | 5/1984 | Barrat et al. | 510/513 |
| 4,741,855 | A | * | 5/1988 | Grote et al. | 510/122 |
| 4,793,943 | A | * | 12/1988 | Haslop et al. | 510/397 |
| 5,062,973 | A | * | 11/1991 | Kellett | 510/519 |
| 5,407,588 | A | | 4/1995 | Butterworth et al. | 252/8.6 |
| 5,965,517 | A | | 10/1999 | Mooney | 510/516 |
| 6,358,913 | B1 | | 3/2002 | Schaumann et al. | 510/515 |

FOREIGN PATENT DOCUMENTS

| | | | |
|---|---|---|---|
| DE | 19818983 | | 11/1998 |
| EP | 0133562 | | 2/1985 |
| EP | 0150872 | | 8/1985 |
| EP | 0356210 | | 2/1990 |
| EP | 0397245 | | 11/1990 |
| EP | 0459822 | | 12/1991 |
| EP | 0739976 | | 10/1996 |
| WO | 95/24460 | | 9/1995 |
| WO | WO 99/09128 | * | 2/1999 |

OTHER PUBLICATIONS

Derwent Abstr. 1985–051175 [09] for EP 0133562 (1985).

Derwent Abstr. 1996–478742 [48] for EP 739976 (1996).

* cited by examiner

*Primary Examiner*—John R. Hardee
(74) *Attorney, Agent, or Firm*—Kevin T. Mansfield

(57) ABSTRACT

The present invention relates to a method of use of a softener composition for imparting hydrophilicity to textile fiber materials in domestic applications, which softener composition comprises:

A) a fabric softener;

B) at least one additive selected form the group consisting of a) a polyethylene, or a mixture thereof, b) a fatty acid alkanolamide, or a mixture thereof, c) a polysilicic acid, and d) a polyurethane;

C) selected polyorganosiloxanes.

13 Claims, No Drawings

FABRIC SOFTENER COMPOSITIONS

This application is a divisional of application Ser. No. 10/089,852, now U.S. Pat. No. 6,831,055, which is the National Stage of International Application PCT/EP00/09396, filed Sep. 26, 2000.

FIELD OF THE INVENTION

The present invention relates to the use of fabric softener compositions comprising selected polyorganosiloxanes, or mixtures thereof, together with selected additives for the improvement of hydrophilicity properties of textile materials in domestic applications. In particular it relates to textile softening compositions for use in a textile laundering operation to impart excellent hydrophilicity properties on the textile.

BACKGROUND OF THE INVENTION

The present invention relates to a method for increasing hydrophilicity of a fabric material. More particularly, the invention relates to a method for imparting a durably increased capacity of water absorption and a durably decreased susceptibility to accumulation of static electricity.

Needless to say, fabric materials currently on use both in the clothing use of people and in the industrial applications are in a very large part produced of synthetic fibers or traditional natural fibers. One of the largest differences between the properties of the synthetic and natural fibers is in the hydrophilicity-hydrophobicity behavior of them, the former fibers being of course outstandingly less hydrophilic than the latter. The remarkably small hydrophilicity of synthetic fibers sometimes causes serious problems not encountered in the use of natural fibers.

For example, fabric materials made of synthetic fibers have a very poor capacity of water or sweat absorption, which is advantageous on one hand but disadvantageous on the other, so that wearers of clothes made of synthetic fibers unavoidably have an unpleasant feeling of heavy stuffiness especially when the clothes are underwears worn in contact with or in the proximity of the skin of the wearer in a hot and humid climate.

Another serious problem caused by the poor hydrophilicity of synthetic fibers is the great accumulation of static electricity on the fibers causing unpleasantness to the wearer of clothes of synthetic fibers in such a charged condition.

Many attempts have of course been proposed and practiced in the prior art to solve these problems by increasing the hydrophilicity of the fabric materials of synthetic fibers and also natural fibres. For example, the problem of poor water absorption of synthetic fibers can be mitigated by the mixed spinning or mixed weaving with water-absorptive natural fibers. The effectiveness of this method is, however, limited since too much amounts of the natural fibers mixed with the synthetic fibers to attain sufficient hydrophilicity of the fabric material naturally result in the loss of the advantages inherent to synthetic fibers. An alternative method is the treatment of the fabric material of synthetic fibers with a water-absorbent agent-to impart hydrophilicity to the surface of the fibers. Extensive investigations have been and are being undertaken in this direction to propose various kinds of water-absorbent agents effective for a particular type of synthetic fibers. For example, the capacity of water absorption of polyester fibers, e.g. polyethylene terephthalate fibers, can be increased by the treatment with a water-soluble polyester resin. Unfortunately, such a method of the treatment of synthetic fibers with a water-soluble resin is defective in several respects of the poor durability of the effects obtained therewith and the adverse influences on the color fastness of dyed fabric materials in many cases.

Limiting the matter to the antistatic treatment or decrease of accumulation of static electricity on the synthetic fibers, various antistatic agents have been proposed hitherto. For example, the above mentioned water-soluble resins including water-soluble polyester resins, polyurethane resins, polyacrylamide resins, polyamide resins and the like are of course effective as an antistatic agent with certain durability. Besides, many compounds are known to be effective as an antistatic agent including inorganic salts such as calcium chloride and lithium chloride, guanidine compounds such as guanidine hydrochloride, surface active agents such as those of the types of quaternary ammonium salts and phosphoric acid esters, acrylic polymers having quaternary cationic groups and the like although the effectiveness of the treatment with these compounds is rather temporary.

The durability of the effects obtained with the above described antistatic agents is, however, not quite satisfactory even with the relatively durable polymeric antistatic agents and the antistatic effects obtained therewith are decreased in the long-run use of the treated fabric materials even by setting aside the other problem of the insufficient effectiveness of the method. Furthermore, the method is also not free from the problem of the decreased color fastness of dyed fabric materials giving limitations to the amount and the manner of use of the antistatic agents.

In short, none of the prior art methods by use of a hydrophilic agent, i.e. water-absorbent agent or antistatic agent, is quite satisfactory for imparting hydrophilicity to the fabric materials in respects of the effectiveness and the durability.

As given above one component of the compositions of the present invention are polyorganosiloxanes. Such compounds are known to be used on an industrial scale to finish fabrics by providing them with a permanent or semi-permanent finish aimed at improving their general appearance. Significant for these industrial fabric finishing processes is a co-called curing step generally involving temperatures in excess of 150° C. often for periods of one hour or more. The object here is to form a chemical finish which resists destruction during subsequent cleaning/laundering of fabrics. This process of finishing is not carried out in domestic applications and accordingly one would not expect benefits of a comparable nature or magnitude from polyorganosiloxanes included as adjuncts in domestic softeners. Indeed, it is noteworthy that if the compounds of the current invention achieved a permanence associated with industrial textile finishing, problems associated with a cumulative build through the wash cycles could occur such as fabric discoloration and even in extremes an unpleasant feel to the wearer.

Surprisingly, it has been found that the use of selected polyorganosiloxanes, or mixtures thereof, and selected additives in fabric softener compositions provide excellent hydrophilic effects when applied to fabrics during a textile laundry operation.

Similar benefits are noted when compositions of the current invention are incorporated into tumble dryer additives such as impregnates on sheets.

SUMMARY OF THE INVENTION

This invention relates to a method of use of a fabric softener composition for imparting hydrophilicity to textile fibre materials in domestic applications, which softener composition comprises:

A) a fabric softener;

B) at least one additive selected from the group consisting of a) a polyethylene, or a mixture thereof, b) a fatty acid alkanolamide, or a mixture thereof, c) a polysilicic acid, or a mixture thereof, and d) a polyurethane, or a mixture thereof; and C) a dispersed polyorganosiloxane of formula (1)

(1)

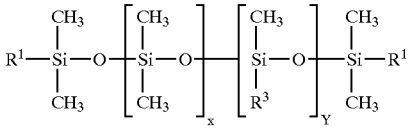

wherein $R^1$ is OH, $OR^2$ or $CH_3$ $R^2$ is $CH_3$ or $CH_2CH_3$ $R^3$ is $C_1$–$C_{20}$alkoxy, $CH_3$, $CH_2CHR^4CH_2NHR^5$, or $CH_2CHR^4CH_2N(COCH_3)R^5$ (2)

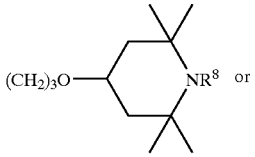

(3)

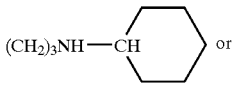

(4)

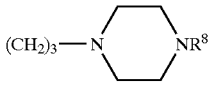

$R^4$ is H or $CH_3$ $R^5$ is H, $CH_2CH_2NHR^6$, C(═O)—$R^7$ or $(CH_2)_z$—$CH_3$ z is 0 to 7

$R^6$ is H or C(═O)—$R^7$ $R^7$ is $CH_3$, $CH_2CH_3$ or $CH_2CH_2CH_2OH$ $R^8$ is H or $CH_3$ the sum of X and Y is 40 to 4000;

or a dispersed polyorganosiloxane which comprises at least one unit of the formula (5)

$$(R^9)_v(R^{10})_w\text{Si—A—B} \quad (5)$$

wherein $R^9$ is $CH_3$, $CH_3CH_2$ or Phenyl $R^{10}$ is —O—Si or —O—$R^9$ the sum of v and w equals 3, and v does not equal 3

A=—$CH_2CH(R^{11})(CH_2)_K$

B=—$NR^{12}((CH_2)_l$—$NH)_mR^{12}$, or (6)

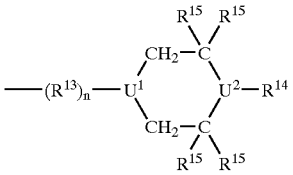

n is 0 or 1 when n is 0, $U^1$ is N, when n is 1, $U^1$ is CH l is 2 to 8 k is 0 to 6 m is 0 to 3

$R^{11}$ is H or $CH_3$ $R^{12}$ is H, C(═O)—$R^{16}$, $CH_2(CH_2)_pCH_3$ or (7)

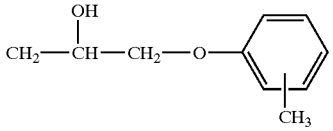

p is 0 to 6

$R^{13}$ is NH, O, $OCH_2CH(OH)CH_2N(Butyl)$, OOCN (Butyl)

$R^{14}$ is H, linear or branched $C_1$–$C_4$ alkyl, Phenyl or $CH_2CH(OH)CH_3$ $R^{15}$ is H or linear or branched $C_1$–$C_4$ alkyl $R^{16}$ is $CH_3$, $CH_2CH_3$ or $(CH_2)_qOH$ q is 1 to 6

$U^2$ is N or CH;

or a dispersed polyorganosiloxane of the formula (8)

(8)

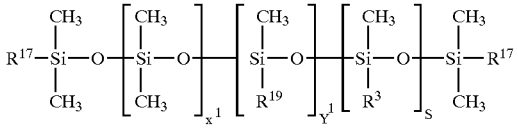

wherein $R^3$ is as previously defined $R^{17}$ is OH, $OR^{18}$ or $CH_3$ $R^{18}$ is $CH_3$ or $CH_2CH_3$ $R^{19}$ is $R^{20}$—$(EO)_m$—$(PO)_n$—$R^{21}$ m is 3 to 25 n is 0 to 10

$R^{20}$ is the direct bond or $CH_2CH(R^{22})(CH_2)_pR^{23}$ p is 1 to 4

$R^{21}$ is H, $R^{24}$, $CH_2CH(R^{22})NH_2$ or $CH(R^{22})CH_2NH_2$ $R^{22}$ is H or $CH_3$ $R^{23}$ is O or NH $R^{24}$ is linear or branched $C_1$–$C_8$ alkyl or $Si(R^{25})_3$ $R^{25}$ is $R^{24}$, $OCH_3$ or $OCH_2CH_3$ EO is —$CH_2CH_2O$—

PO is —$CH(CH_3)CH_2O$— or —$CH_2CH(CH_3)O$— the sum of $X_1$, $Y_1$ and S is 20 to 1500;

or a dispersed polyorganosiloxane of the formula (9)

(9)

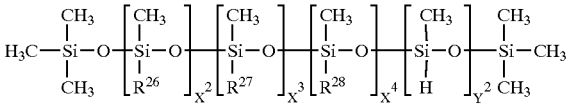

wherein $R^{26}$ is linear or branched $C_1$–$C_{20}$ alkoxy, $CH_2CH(R^4)R^{29}$ $R^4$ is as previously defined $R^{29}$ is linear or branched $C_1$–$C_{20}$ alkyl $R^{27}$ is aryl, aryl substituted by linear or branched $C_1$–$C_{10}$ alkyl, linear or branched $C_1$–$C_{20}$ alkyl substituted by aryl or aryl substituted by linear or branched $C_1$–$C_{10}$ alkyl $R^{28}$ is (10)

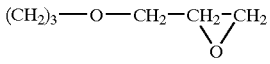

the sum of $X^2$, $X^3$, $X^4$ and $Y^2$ is 20 to 1500, wherein $X^3$, $X^4$ and $Y^2$ may be independently of each other 0;

or a mixture thereof.

The composition is preferably used as a liquid rinse conditioner composition. The textile fibre materials are treated for hydrophilicity.

In tumble dryer applications the compositions are usually incorporated into impregnates on non-woven sheets. However, other application forms are known to those skilled in the art.

The fabric softener composition (especially in liquid form) will be used after the textile fibre materials have been washed with a laundry detergent, which may be one of a broad range of detergent types. The tumble dryer sheet will be used after a laundering process. The textile fibre materials may be damp or dry.

The fabric softener composition may also be sprayed directly onto the fabrics prior to or during the ironing or drying of the treated fabrics.

The polyorganosiloxane may be anionic, nonionic or cationic, preferably nonionic or cationic.

The polyorganosiloxanes, or mixtures thereof, are used in a dispersed form, via the use of an emulsifier. The fabric softener composition is preferably in aqueous liquid form. The water content as a rule is 25 to 90% by weight based on the total weight of the composition.

When the polyorganosiloxane contains a nitrogen atom, the nitrogen content of the aqueous emulsion due to the polyorganosiloxane is preferably from 0.001 to 0.25% with respect to the silicon content. In general, a nitrogen content from 0.001 to 0.25% is preferred. The particles of the emulsion as a rule have a diameter of between 5 nm and 1000 nm.

The fabric softener composition preferably has a solids content of 5 to 70% at a temperature of 120° C.

The fabric softener composition usually has a pH value from 2.0 to 7.0, especially 2.0 to 5.0.

The fabric softener composition may further comprise an additional polyorganosiloxane:

(11)

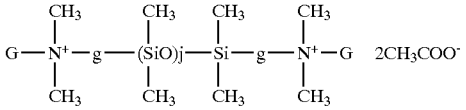

wherein g is (12)

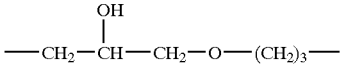

and G is $C_1$ to $C_{20}$ alkyl.

This polydimethylsiloxane is cationic, has a viscosity at 25° C. of 250 $mm^2s^{-1}$ to 450 $mm^2s^{-1}$, has a specific gravity of 1.00 to 1.02 $g/cm^3$ and has a surface tension of 28.5 $mNm^{-1}$ to 33.5 $mNm^{-1}$.

The fabric softener composition may further comprise an additional polyorganosiloxane, such as that known as Magnasoft HSSD, or a polyorganosiloxane of the formula:

(13)

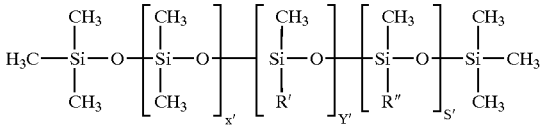

R" is $CH_2CH_2CH_2N(R'''')_2$

R'" is linear or branched $C_1$–$C_4$ alkyl

R' is $(CH_2)_{x''}$—$(EO)_m$—$(PO)_n$—R""

m is 3 to 25 n is 0 to 10

X" is 0 to 4

R'" is H or linear or branched $C_1$–$C_4$ alkyl

EO is —$CH_2CH_2O$—

PO is —$CH(CH_3)CH_2O$— or —$CH_2CH(CH_3)O$— the sum of X', Y' and S' is 40 to 300.

Preferably the compositions comprise dispersed polyorganosiloxanes of formula (1):

(1)

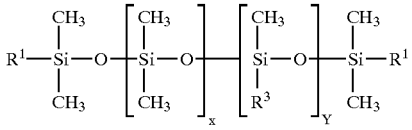

wherein $R^1$ is OH, $OR^2$ or $CH_3$ $R^2$ is $CH_3$ or $CH_2CH_3$ $R^3$ is $C_1$–$C_{20}$alkoxy, $CH_3$, $CH_2CHR^4CH_2NHR^5$, or (2)

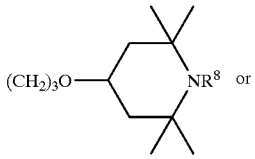

or (3)

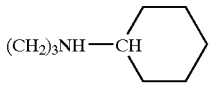

$R^4$ is H or $CH_3$ $R^5$ is H, $CH_2CH_2NHR^6$, C(=O)—$R^7$ $R^6$ is H or C(=O)—$R^7$ $R^7$ is $CH_3$, $CH_2CH_3$ or $CH_2CH_2CH_2OH$ $R^8$ is H or $CH_3$ the sum of X and Y is 40 to 4000, especially 40 to 2000;

or a dispersed polyorganosiloxane which comprises at least one unit of the formula (5);

$$(R^9)_v(R^{10})_w\text{Si—A—B} \quad (5)$$

wherein $R^9$ is $CH_3$, $CH_3CH_2$ $R^{10}$ is —O—Si or —O—$R^9$ the sum of v and w equals 3, and v does not equal 3

A=—$CH_2CH(R^{11})(CH_2)_K$

B=

(6)

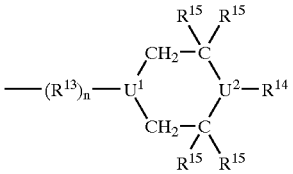

n is 1

$U^1$ is CH k is 0 to 6

$R^{11}$ is H or $CH_3$ $R^{13}$ is OOCN(Butyl)

$R^{14}$ is H, linear $C_1$–$C_4$ alkyl, Phenyl $R^{15}$ is H or linear $C_1$–$C_4$ alkyl $U^2$ is N;

or a dispersed polyorganosiloxane of the formula (8);

(8)

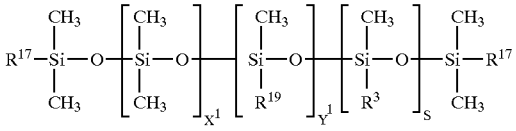

wherein $R^3$ is as previously defined $R^{17}$ is OH, $OR^{18}$ or $CH_3$ $R^{18}$ is $CH_3$ or $CH_2CH_3$ $R^{19}$ is $R^{20}$—$(EO)_m$—$(PO)_n$—$R^{21}$ m is 3 to 25 n is 0 to 10

$R^{20}$ is the direct bond or $CH_2CH(R^{22})(CH_2)_pR^{23}$ p is 1 to 4

$R^{21}$ is H, $R^{24}$, $CH_2CH(R^{22})NH_2$ or $CH(R^{22})CH_2NH_2$ $R^{22}$ is H or $CH_3$ $R^{23}$ is O or NH $R^{24}$ is linear or branched $C_1$–$C_3$ alkyl or $Si(R^{25})_3$ $R^{25}$ is $R^{24}$, $OCH_3$ or $OCH_2CH_3$ EO is —$CH_2CH_2O$—

PO is —$CH(CH_3)CH_2O$— or —$CH_2CH(CH_3)O$— the sum of $X^1$, $Y^1$ and s is 20 to 1500;

or a dispersed polyorganosiloxane of the formula (9);

(9)

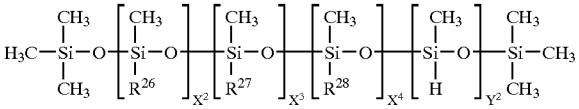

$R^{26}$ is linear $C_1$–$C_{20}$ alkoxy, $R^4$ is as previously defined $R^{29}$ is linear $C_1$–$C_{20}$ alkyl $R^{27}$ is, $CH_2CH(R^4)$Phenyl $R^{28}$ is (10)

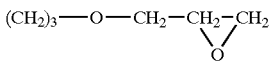

the sum of $X^2$, $X^3$, $X^4$ and $Y^2$ is 20 to 1500, wherein $X^3$, $X^4$ and $Y^2$ may be independently of each other 0;

or a mixture thereof.

The fabric softener composition may further comprise an additional polyorganosiloxane:

(11)

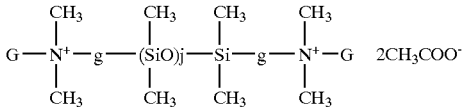

wherein g is (12)

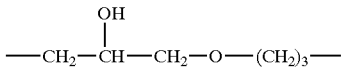

and G is $C_1$ to $C_{20}$ alkyl.

This polydimethylsiloxane is cationic, has a viscosity at 25° C. of 250 $mm^2s^{-1}$ to 450 $mm^2s^{-1}$, has a specific gravity of 1.00 to 1.02 $g/cm^3$ and has a surface tension of 28.5 $mNm^{-1}$ to 33.5 $mNm^{-1}$.

As to the polyorganosiloxanes of formula (1) the following preferences apply:

$R^1$ is preferably OH or $CH_3$.

$R^3$ is preferably $CH_3$, $C_{10}$–$C_{20}$alkoxy or $CH_2CHR^4CH_2NHR^5$.

$R^4$ is preferably H.

$R^5$ is preferably H or $CH_2CH_2NHR^6$.

$R^6$ is preferably H or C(=O)—$R^7$.

$R^7$ is preferably $CH_3$, $CH_2CH_3$ or especially $CH_2CH_2CH_2OH$.

The sum of X+Y is preferably 100 to 2000.

Preferred are polyorganosiloxanes of formula (1) wherein $R^1$ is OH or $CH_3$, $R^3$ is $CH_3$, $C_{10}$–$C_{20}$alkoxy or $CH_2CHR^4CH_2NHR^5$, $R^4$ is H, $R^5$ is H or $CH_2CH_2NHR^6$, $R^6$ is H or C(=O)—$R^7$, and $R^7$ is $CH_3$, $CH_2CH_3$ or especially $CH_2CH_2CH_2OH$.

As to the polyorganosiloxanes of formula (8) the following preferences apply:

$R^3$ is preferably $CH_3$, $C_{10}$–$C_{20}$alkoxy or $CH_2CHR^4CH_2NHR^5$.

$R^4$ is preferably H.

$R^5$ is preferably H or $CH_2CH_2NHR^6$.

$R^6$ is preferably H or C(=O)—$R^7$.

$R^7$ is preferably $CH_2CH_3$, $CH_2CH_2CH_2OH$ or especially $CH_3$.

$R_{17}$ is preferably $CH_3$ or OH.

$R_{20}$ is preferably the direct bond.

$R_{21}$ is preferably H.

Preferred are polyorganosiloxanes of formula (8) wherein $R^3$ is $CH_3$, $C_{10}$–$C_{20}$alkoxy or $CH_2CHR^4CH_2NHR^5$, $R^4$ is H, $R^5$ is H or $CH_2CH_2NHR^6$, $R^6$ is H or C(=O)—$R^7$, $R^7$ is $CH_2CH_3$, $CH_2CH_2CH_2OH$ or especially $CH_3$, and $R_{17}$ is $CH_3$ or OH.

As to the polyorganosiloxanes of formula (9) the following preferences apply:

$R^{26}$ is preferably $CH_2CH(R^4)R^{29}$.

$R^4$ is preferably H.

$R^{27}$ is preferably 2-phenyl propyl.

The sum of $X^2$, $X^3$, $X^4$ and $Y^2$ is preferably 40 to 500.

Preferred are polyorganosiloxanes of formula (9) wherein $R^{26}$ is $CH_2CH(R^4)R^{29}$, $R^4$ is H, and $R^{27}$ is 2-phenyl propyl.

Preferred are polyorganosiloxanes of formulae (1), (8) and (9), especially those of formulae (1) and (8). Very interesting polyorganosiloxanes are those of formula (1).

Emulsifiers used to prepare the polyorganosiloxane compositions include:

i) Ethoxylates, such as alkyl ethoxylates, amine ethoxylates or ethoxylated alkylammoniumhalides. Alkyl ethoxylates include alcohol ethoxylates or isotridecyl ethoxylates. Preferred alcohol ethoxylates include linear or branched nonionic alkyl ethoxylates containing 2 to 15 ethylene oxide units. Preferred isotridecyl ethoxylates include nonionic isotridecyl ethoxylates containing 5 to 25 ethylene oxide units. Preferred amine ethoxylates include nonionic C10 to C20 alkyl amino ethoxylates containing 4 to 10 ethylene oxide units. Preferred ethoxylated alkylammoniumhalides include nonionic or cationic ethoxylated C6 to C20 alkyl bis(hydroxyethyl)methylammonium chlorides.
ii) Alkylammonium halides, preferably cationic quaternary ester alkylammonium halides.
iii) Silicones, preferably nonionic polydimethylsiloxane polyoxyalkylene copolymers
iv) Saccharides, preferably nonionic alkylpolyglycosides.

A mixture of these emulsifiers may also be used.

As mentioned previously, the compositions further comprise one or more additives selected from polyethylene, dispersed fatty acid alkanol amide, polysilicic acid and polyurethane. These components are described below.

The emulsifiable polyethylene (polyethylene wax) is known and is described in detail in the prior art (compare, for example, DE-C-2,359,966, DE-A-2,824,716 and DE-A-1,925,993). The emulsifiable polyethylene is as a rule a polyethylene having functional groups, in particular COOH groups, some of which can be esterified. These functional groups are introduced by oxidation of the polyethylene. However, it is also possible to obtain the functionality by copolymerization of ethylene with, for example, acrylic acid. The emulsifiable polyethylenes preferably have a density of at least 0.91 g/cm$^3$ at 20° C., an acid number of at least 5 and a saponification number of at least 10. Emulsifiable polyethylenes which have a density of 0.95 to 1.05 g/cm$^3$ at 20° C., an acid number of 10 to 60 and a saponification number of 15 to 80 are particularly preferred. Polyethylenes which have a drop point of 100–150° C. are preferred. This material is generally obtainable commercially in the form of flakes, lozenges and the like. A mixture of these emulsifiable polyethylenes may also be used.

The polyethylene wax is usually employed in the form of dispersions. Various emulsifiers are suitable for their preparation. The preparation of the dispersions is described in detail in the prior art.

Emulsifiers suitable for dispersing the polyethylene component include:

i) Ethoxylates, such as alkyl ethoxylates or amine ethoxylates. Alkyl ethoxylates include alcohol ethoxylates or isotridecyl ethoxylates. Preferred alcohol ethoxylates include nonionic fatty alcohol ethoxylates containing 2 to 55 ethylene oxide units. Preferred isotridecyl ethoxylates include nonionic isotridecyl ethoxylates containing 6 to 9 ethylene oxide units. Preferred amine ethoxylates include nonionic C10 to C20 alkyl amino ethoxylates containing 7 to 9 ethylene oxide units.
ii) Alkylammonium halides, preferably cationic quaternary ester alkylammonium halides.
iii) Ammonium salts, preferably cationic aliphatic quaternary ammonium chloride or sulfate.

A mixture of these emulsifiers may also be used.

Suitable fatty acid alkanolamides are for example those of formula

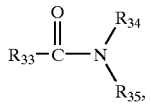

(14)

wherein $R_{33}$ is a saturated or unsaturated hydrocarbon radical containing 10 to 24 carbon atoms, $R_{34}$ is hydrogen or a radical of formula —$CH_2OH$, —$(CH_2CH_2O)_cH$ or

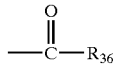

wherein c is a number from 1 to 10 and $R_{36}$ is as defined above for $R_{33}$, and $R_{35}$ is a radical of formula

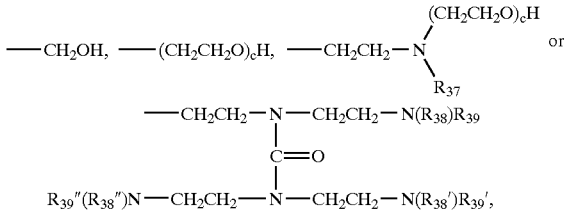

and c is as defined above, $R_{37}$ is hydrogen or a radical of formula

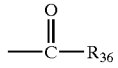

wherein $R_{36}$ is as defined above, $R_{38}$, $R_{38}$' and $R_{38}$" have the same or different meaning and are as defined above for $R_{34}$, and $R_{39}$, $R_{39}$' and $R_{39}$" have the same or different meaning and are a radical of formula

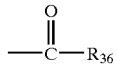

wherein $R_{36}$ is as defined above.

$R_{33}$ and $R_{36}$ are preferably a saturated or unsaturated hydrocarbon radical containing 14 to 24 carbon atoms. Preferred are saturated hydrocarbon radicals.

$R_{34}$ is preferably hydrogen, —$CH_2OH$ or a radical of formula

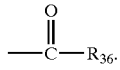

$R_{35}$ is preferably a radical of formula

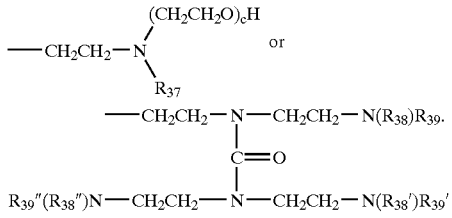

As to $R_{38}$, $R_{38}'$ and $R_{38}''$ the preferences given above for $R_{34}$ apply.

c is preferably a number from 1 to 5.

Preferred are fatty acid alkanolamides of formula (15a)

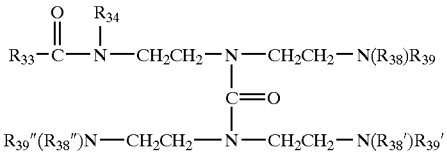

wherein $R_{33}$, $R_{34}$, $R_{38}$, $R_{38}'$, $R_{38}''$, $R_{39}$, $R_{39}'$ and $R_{39}''$ are as defined above.

Preferred are fatty acid alkanolamides of formula (15a), wherein $R_{34}$, $R_{38}$, $R_{38}'$ and $R_{38}''$ are hydrogen or —$CH_2OH$.

Furthermore, fatty acid alkanolamides of formula (15b)

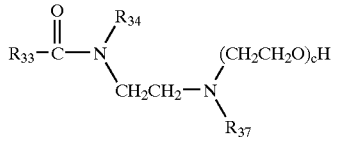

are preferred, wherein $R_{33}$, $R_{34}$, $R_{37}$ and c are as defined above.

Preferred are fatty acid alkanolamides of formula (15b), wherein $R_{34}$ and $R_{37}$ are hydrogen or a radical of formula

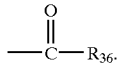

$R_{34}$ is preferably hydrogen.

The above fatty acid alkanolamides can also be present in form of the corresponding ammonium salts.

A mixture of these fatty acid alkanolamides may also be used.

Emulsifiers suitable for dispersing the fatty acid alkanol amide component include:

i) Ethoxylates, such as alkyl ethoxylates, amine ethoxylates or amide ethoxylates. Alkyl ethoxylates include alcohol ethoxylates or isotridecyl ethoxylates. Preferred alcohol ethoxylates include nonionic fatty alcohol ethoxylates containing 2 to 55 ethylene oxide units. Preferred isotridecyl ethoxylates include nonionic isotridecyl ethoxylates containing 5 to 45 ethylene oxide units. Preferred amine ethoxylates include nonionic C10 to C20 alkyl amino ethoxylates containing 4 to 25 ethylene oxide units. Preferred amide ethoxylates include cationic fatty acid amide ethoxylates containing 2 to 25 ethylene oxide units.

ii) Alkylammonium halides, preferably cationic quaternary ester alkylammonium halides or cationic aliphatic acid alkylamidotrialkylammonium methosulfates.

iii) Ammonium salts, preferably cationic aliphatic quaternary ammonium chloride or sulfate.

A mixture of these emulsifiers may also be used.

Examples for polyurethanes are the reaction products of a diol and an ethoxysilate with a diisocyanate.

The additives selected from the group consisting of a polyethylene, a fatty acid alkanolamide, a polysilicic acid, and a polyurethane are, as a rule, used in an amount of 0.01 to 25% by weight, especially 0.01 to 15% by weight, based on the total weight of the fabric softener composition. An amount of 0.05 to 15% by weight, especially 0.1 to 15% by weight, is preferred. Highly preferred is an upper limit of 10%, especially 5%.

Preferred as additives are polyethylene, fatty acid alkanolamides and polyurethanes, especially polyethylene and fatty acid alkanolamides. Highly preferred are polyethylene.

A highly preferred fabric softener composition used according to the present invention comprises:

a) 0.01 to 70% by weight based on the total weight of the composition of a polyorganosiloxane, or a mixture thereof;

b) 0.2 to 15% by weight based on the total weight of an emulsifier, or a mixture thereof;

c) 0.01 to 25% by weight, especially 0.01 to 15% by weight, based on the total weight of at least one additive selected from the group consisting of a polyethylene, a fatty acid alkanolamide, a polysilicic acid, or a polyurethane, and d) water to 100%.

The fabric softener compositions can be prepared as follows:

Firstly, emulsions of the polyorganosiloxane are prepared. The polyorganosiloxane and polyethylene, fatty acid alkanol amide, polysilicic acid or polyurethane are emulsified in water using one or more surfactants and shear forces, e.g. by means of a colloid mill. Suitable surfactants are described above. The components may be emulsified individually before being mixed together, or emulsified together after the components have been mixed. The surfactant(s) is/are used in customary amounts known to the person skilled in the art and can be added either to the polyorganosiloxane or to the water prior to emulsification. Where appropriate, the emulsification operation can be carried out at elevated temperature. The fabric softener composition according to the invention is usually, but not exclusively, prepared by firstly stirring the active substance, i.e. the hydrocarbon based fabric softening component, in the molten state into water, then, where required, adding further desired additives and, finally, after cooling, adding the polyorganosiloxane emulsion.

The fabric softener composition can, for example, be prepared by mixing a preformulated fabric softener with an emulsion comprising the polyorganosiloxane and the additive.

The fabric softening components can be conventional hydrocarbon based fabric softening components known in the art.

Hydrocarbon fabric softeners suitable for use herein are selected from the following classes of compounds:

(i) Cationic quaternary ammonium salts. The counter ion of such cationic quaternary ammonium salts may be a halide, such as chloride or bromide, methyl sulphate, or other ions well known in the literature. Preferably the counter ion is methyl sulfate or any alkyl sulfate or any halide, methyl sulfate being most preferred for the dryer-added articles of the invention.

Examples of cationic quaternary ammonium salts include but are not limited to:

(1) Acyclic quaternary ammonium salts having at least two $C_8$ to $C_{30}$, preferably $C_{12}$ to $C_{22}$ alkyl or alkenyl chains, such as: ditallowdimethyl ammonium methylsulfate, di(hydrogenated tallow)dimethyl ammonium methylsulfate, distearyldimethyl ammonium methylsulfate, dicocodimethyl ammonium methylsulfate and the like. It is especially preferred if the fabric softening compound is a water insoluble quaternary ammonium material which comprises a compound having two $C_{12}$ to $C_{18}$ alkyl or alkenyl groups connected to the molecule via at least one ester link. It is more preferred if the quaternary ammonium material has two ester links present. An especially preferred ester-linked quaternary ammonium material for use in the invention can be represented by the formula:

(16)

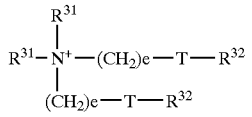

wherein each $R^{31}$ group is independently selected from $C_1$ to $C_4$ alkyl, hydroxyalkyl or $C_2$ to $C_4$ alkenyl groups; T is either (17)

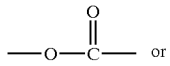

or (18)

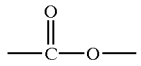

and wherein each $R^{32}$ group is independently selected from $C_8$ to $C_{28}$ alkyl or alkenyl groups; and e is an integer from 0 to 5.

A second preferred type of quaternary ammonium material can be represented by the formula:

A second preferred type of quaternary ammonium material can be represented by the formula:

(19)

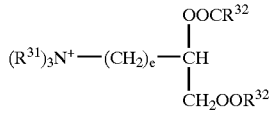

wherein $R^{31}$, e and $R^{32}$ are as defined above.

(2) Cyclic quaternary ammonium salts of the imidazolinium type such as di(hydrogenated tallow)dimethyl imidazolinium methylsulfate, 1-ethylene-bis(2-tallow-1-methyl) imidazolinium methylsulfate and the like;

(3) Diamido quaternary ammonium salts such as: methyl-bis(hydrogenated tallow amidoethyl)-2-hydroxethyl ammonium methyl sulfate, methyl bi(tallowamidoethyl)-2-hydroxypropyl ammonium methylsulfate and the like;

(4) Biodegradable quaternary ammonium salts such as N,N-di(tallowoyl-oxy-ethyl)-N,N-dimethyl ammonium methyl sulfate and N,N-di(tallowoyl-oxy-propyl)-N,N-dimethyl ammonium methyl sulfate. Biodegradable quaternary ammonium salts are described, for example, in U.S. Pat. Nos. 4,137,180, 4,767,547 and 4,789,491 incorporated by reference herein.

Preferred biodegradable quaternary ammonium salts include the biodegradable cationic diester compounds as described in U.S. Pat. No. 4,137,180, herein incorporated by reference.

(ii) Tertiary fatty amines having at least one and preferably two C8 to C30, preferably C12 to C22 alkyl chains. Examples include hardened tallow-di-methylamine and cyclic amines such as 1-(hydrogenated tallow)amidoethyl-2-(hydrogenated tallow) imidazoline. Cyclic amines which may be employed for the compositions herein are described in U.S. Pat. No. 4,806,255 incorporated by reference herein.

(iii) Carboxylic acids having 8 to 30 carbons atoms and one carboxylic group per molecule. The alkyl portion has 8 to 30, preferably 12 to 22 carbon atoms. The alkyl portion may be linear or branched, saturated or unsaturated, with linear saturated alkyl preferred. Stearic acid is a preferred fatty acid for use in the composition herein. Examples of these carboxylic acids are commercial grades of stearic acid and palmitic acid, and mixtures thereof which may contain small amounts of other acids.

(iv) Esters of polyhydric alcohols such as sorbitan esters or glycerol stearate. Sorbitan esters are the condensation products of sorbitol or iso-sorbitol with fatty acids such as stearic acid. Preferred sorbitan esters are monoalkyl. A common example of sorbitan ester is SPAN 60 (ICI) which is a mixture of sorbitan and isosorbide stearates.

(v) Fatty alcohols, ethoxylated fatty alcohols, alkyphenols, ethoxylated alkyphenols, ethoxylated fatty amines, ethoxylated monoglycerides and ethoxylated diglycerides.

(vi) Mineral oils, and polyols such as polyethylene glycol.

These softeners are more definitively described in U.S. Pat. No. 4,134,838 the disclosure of which is incorporated by reference herein. Preferred fabric softeners for use herein are acyclic quaternary ammonium salts. Di(hydrogenated) tallowdimethyl ammonium methylsulfate is most widely used for dryer articles of this invention. Mixtures of the above mentioned fabric softeners may also be used.

The fabric softening composition employed in the present invention contains as a rule about 0.1% to about 95% of the fabric softening component. Preferably from about 2% to about 70% and most preferably from about 2% to about 30% of the fabric softening component is employed herein to obtain optimum softening at minimum cost. When the fabric softening component includes a quaternary ammonium salt, the salt is used in the amount of about 2% to about 70%, preferably about 2% to about 30%.

The fabric softener composition may also comprise additives which are customary for standard commercial liquid rinse conditioners, for example alcohols, such as ethanol, n-propanol, i-propanol, polyhydric alcohols, for example glycerol and propylene glycol; amphoteric and nonionic surfactants, for example carboxyl derivatives of imidazole, oxyethylated fatty alcohols, hydrogenated and ethoxylated castor oil, alkyl polyglycosides, for example decyl polyglucose and dodecylpolyglucose, fatty alcohols, fatty acid esters, fatty acids, ethoxylated fatty acid glycerides or fatty acid partial glycerides; also inorganic or organic salts, for example water-soluble potassium, sodium or magnesium salts, non-aqueous solvents, pH buffers, perfumes, dyes, hydrotropic agents, antifoams, anti redeposition agents, polymeric or other thickeners, enzymes, optical brighteners, antishrink agents, stain removers, germicides, fungicides, antioxidants and corrosion inhibitors.

These fabric softener compositions are traditionally prepared as dispersions containing for example up to 20% by weight of active material in water. They have a turbid appearance. However, alternative formulations usually containing actives at levels of 5 to 40% along with solvents can be prepared as microemulsions which have a clear appearance (as to the solvents and the formulations see for example U.S. Pat. No. 5,543,067 und WO-A-98/17757). The additives and polyorganosiloxanes of the present invention can be used for such compositions although it will be necessary to use them in microemulsion form to preserve the clear appearance of the fabric softener compositions which are microemulsions.

Another aspect of the invention is a tumble dryer sheet article. The fabric softener composition of the present invention may be coated onto a flexible substrate which carries a fabric conditioning amount of the composition and is capable of releasing the composition at dryer operating temperatures. The conditioning composition in turn has a preferred melting (or softening) point of about 25° C. to about 150° C.

The fabric softener composition which may be employed in the invention is coated onto a dispensing means which effectively releases the fabric conditioning composition in a tumble dryer. Such dispensing means can be designed for single usage or for multiple uses. One such multi-use article comprises a sponge material releasably enclosing enough of the conditioning composition to effectively impart fabric softness during several drying cycles. This multi-use article can be made by filling a porous sponge with the composition. In use, the composition melts and leaches out through the pores of the sponge to soften and condition fabrics. Such a filled sponge can be used to treat several loads of fabrics in conventional dryers, and has the advantage that it can remain in the dryer after use and is not likely to be misplaced or lost.

Another article comprises a cloth or paper bag releasably enclosing the composition and sealed with a hardened plug of the mixture. The action and heat of the dryer opens the bag and releases the composition to perform its softening.

A highly preferred article comprises the inventive compositions releasably affixed to a flexible substrate such as a sheet of paper or woven or non-woven cloth substrate. When such an article is placed in an automatic laundry dryer, the heat, moisture, distribution forces and tumbling action of the dryer removes the composition from the substrate and deposits it on the fabrics.

The sheet conformation has several advantages. For example, effective amounts of the compositions for use in conventional dryers can be easily absorbed onto and into the sheet substrate by a simple dipping or padding process. Thus, the end user need not measure the amount of the composition necessary to obtain fabric softness and other benefits. Additionally, the flat configuration of the sheet provides a large surface area which results in efficient release and distribution of the materials onto fabrics by the tumbling action of the dryer.

The substrates used in the articles can have a dense, or more preferably, open or porous structure. Examples of suitable materials which can be used as substrates herein include paper, woven cloth, and non-woven cloth. The term "cloth" herein means a woven or non-woven substrate for the articles of manufacture, as distinguished from the term "fabric" which encompasses the clothing fabrics being dried in an automatic dryer.

It is known that most substances are able to absorb a liquid substance to some degree; however, the term "absorbent", as used herein, is intended to mean a substrate with an absorbent capacity (i.e., a parameter representing a substrates ability to take up and retain a liquid) from 4 to 12, preferably 5 to 7 times its weight of water.

If the substrate is a foamed plastics material, the absorbent capacity is preferably in the range of 15 to 22, but some special foams can have an absorbent capacity in the range from 4 to 12.

Determination of absorbent capacity values is made by using the capacity testing procedures described in U.S. Federal Specifications (UU-T-595b), modified as follows:

1. tap water is used instead of distilled water;
2. the specimen is immersed for 30 seconds instead of 3 minutes;
3. draining time is 15 seconds instead of 1 minute; and
4. the specimen is immediately weighed on a torsion balance having a pan with turned-up edges.

Absorbent capacity values are then calculated in accordance with the formula given in said Specification. Based on this test, one-ply, dense bleached paper (e.g., Kraft or bond having a basis weight of about 32 pounds per 3,000 square feet) has an absorbent capacity of 3.5 to 4; commercially available household one-ply towel paper has a value of 5 to 6; and commercially available two-ply household towelling paper has a value of 7 to about 9.5.

Suitable materials which can be used as a substrate in the invention herein include, among others, sponges, paper, and woven and non-woven cloth, all having the necessary absorbency requirements defined above.

The preferred non-woven cloth substrates can generally be defined as adhesively bonded fibrous or filamentous products having a web or carded fiber structure (where the fiber strength is suitable to allow carding), or comprising fibrous mats in which the fibers or filaments are distributed haphazardly or in random array (i.e. an array of fibers is a carded web wherein partial orientation of the fibers is frequently present, as well as a completely haphazard distributional orientation), or substantially aligned. The fibers or filaments can be natural (e.g. wool, silk, jute, hemp, cotton, linen, sisal, or ramie) or synthetic (e.g. rayon, cellulose ester, polyvinyl derivatives, polyolefins, polyamides, or polyesters).

The preferred absorbent properties are particularly easy to obtain with non-woven cloths and are provided merely by building up the thickness of the cloth, i.e., by superimposing a plurality of carded webs or mats to a thickness adequate to obtain the necessary absorbent properties, or by allowing a sufficient thickness of the fibers to deposit on the screen. Any diameter or denier of the fiber (generally up to about 10 denier) can be used, inasmuch as it is the free space between each fiber that makes the thickness of the cloth directly related to the absorbent capacity of the cloth, and which, further, makes the non-woven cloth especially suitable for impregnation with a composition by means of intersectional or capillary action. Thus, any thickness necessary to obtain the required absorbent capacity can be used.

When the substrate for the composition is a non-woven cloth made from fibers deposited haphazardly or in random array on the screen, the articles exhibit excellent strength in all directions and are not prone to tear or separate when used in the automatic clothes dryer.

Preferably, the non-woven cloth is water-laid or air-laid and is made from cellulosic fibers, particularly from regenerated cellulose or rayon. Such non-woven cloth can be lubricated with any standard textile lubricant.

Preferably, the fibers are from 5 mm to 50 mm in length and are from 1.5 to 5 denier. Preferably, the fibers are at least partially orientated haphazardly, and are adhesively bonded together with a hydrophobic or substantially hydrophobic binder-resin. Preferably, the cloth comprises about 70% fiber and 30% binder resin polymer by weight and has a basis weight of from about 18 to 45g per square meter.

In applying the fabric softener composition to the absorbent substrate, the amount impregnated into and/or coated onto the absorbent substrate is conveniently in the weight ratio range of from about 10:1 to 0.5:1 based on the ratio of total conditioning composition to dry, untreated substrate (fiber plus binder). Preferably, the amount of the conditioning composition ranges from about 5:1 to about 1:1, most preferably from about 3:1 to 1:1, by weight of the dry untreated substrate.

According to one preferred embodiment of the invention, the dryer sheet substrate is coated by being passed over a rotogravure applicator roll. In its passage over this roll, the sheet is coated with a thin, uniform layer of molten fabric softening composition contained in a rectangular pan at a level of about 15g per square yard. Passage for the substrate over a cooling roll then solidifies the molten softening composition to a solid. This type of applicator is used to obtain a uniform homogeneous coating across the sheet.

Following application of the liquefied composition, the articles are held at room temperature until the composition substantially solidifies. The resulting dry articles, prepared at the composition substrate ratios set forth above, remain flexible; the sheet articles are suitable for packaging in rolls. The sheet articles can optionally be slitted or punched to provide a non-blocking aspect at any convenient time if desired during the manufacturing process.

The fabric softener composition employed in the present invention includes certain fabric softeners which can be used singly or in admixture with each other.

Examples of suitable textile fibre materials which can be treated with the fabric softener composition are materials made of silk, wool, polyamide, acrylics or polyurethanes, and, in particular, cellulosic fibre materials of all types. Such fibre materials are, for example, natural cellulose fibres, such as cotton, linen, jute and hemp, and regenerated cellulose. Preference is given to textile fibre materials made of cotton. The fabric softener compositions are also suitable for hydroxyl-containing fibres which are present in mixed fabrics, for example mixtures of cotton with polyester fibres or polyamide fibres.

A better understanding of the present invention and of its many advantages will be had by referring to the following Examples, given by way of illustration. The percentages given in the examples are percentages by weight.

EXAMPLE 1

Preparation of the Rinse Conditioners

The liquid rinse conditioners are prepared by using the procedure described below. This type of fabric rinse conditioners is normally known under the name of "triple strength" or "triple fold" formula.

75% by weight of the total amount of water is heated to 40° C. The molten fabric softener di-(palmcarboxyethyl-) hydroxyethyl-methylammonium-methosulfate (or Rewoquat WE 38 DPG available from Witco) is added to the heated water under stirring and the mixture is stirred for 1 hour at 40° C. Afterwards the aqueous softener solution is cooled down to below 30° C. while stirring. When the solution cools down sufficiently magnesium chloride is added and the pH is adjusted to 3.2 with 0.1 N hydrochloric acid. The formulation is then filled up with water to 100%.

The rinse conditioner formulation as described above was used as a base formulation. In a final step the fabric softener is mixed with a separately prepared polyorganosiloxane/additive emulsion. The fabric softener formulations used in the following examples are listed in the following Table 1.

TABLE 1

(rinse conditioner formulations used in the application test for 1 kg wash load)

| Rinse conditioner formulation | Polyorgano-siloxane emulsion (calculated on solid content of the emulsion) | Fabric softener Base Formulation | pH |
|---|---|---|---|
| 0 (Reference) | — | 13.3 g | 3.2 |
| A | 0.2 g of Type I | 13.3 g | 3.2 |
| B | 0.2 g of Type II | 13.3 g | 3.2 |
| C | 0.2 g of Type III | 13.3 g | 3.2 |
| D | 0.2 g of Type IV | 13.3 g | 3.2 |
| E | 0.2 g of Type V | 13.3 g | 3.2 |
| F | 0.2 g of Type VI | 13.3 g | 3.2 |
| G | 0.2 g of Type VII | 13.3 g | 3.2 |
| H | 0.2 g of Type VIII | 13.3 g | 3.2 |
| I | 0.2 g of Type IX | 13.3 g | 3.2 |
| J | 0.2 g of Type X | 13.3 g | 3.2 |

TABLE 1-continued (rinse conditioner formulations used in the application test for 1 kg wash load)

| Rinse conditioner formulation | Polyorgano-siloxane emulsion (calculated on solid content of the emulsion) | Fabric softener Base Formulation | pH |
|---|---|---|---|
| K | 0.2 g of Type XI | 13.3 g | 3.2 |
| L | 0.2 g of Type XII | 13.3 g | 3.2 |
| M | 0.2 g of Type XV | 13.3 g | 3.2 |

Types of Polyorganosiloxane Emulsions Used

Type I

Polyorganosiloxane of general formula (1), wherein $R_1$ is —OH, $R_3$ is —$CH_3$, X+Y=300–1500, % nitrogen (with respect to silicone)=0

3.7% of an emulsifier 12.5% of an emulsifiable oxidised polyethylene which has a density of 0.95 to 1.05 g/cm$^3$ at 20° C., a drop point of 100–150° C., an acid number of 10 to 60 and a saponification number of 15 to 80 solid content of the emulsion measured by evaporation at 120° C.=27.0–29.0% water content=71.3%

Type II

Polyorganosiloxane of general formula (1), wherein $R_1$ is —OH, $R_3$ is —$CH_2CH_2CH_2NH_2$, X+Y=300–1500, % nitrogen (with respect to silicone)=0.025

4.5% of an emulsifier

1% of an emulsifiable oxidised polyethylene which has a density of 0.95 to 1.05 g/cm$^3$ at 20° C., a drop point of 100–150° C., an acid number of 10 to 60 and a saponification number of 15 to 80 solid content of the emulsion measured by evaporation at 120° C.=37.0–39.0% water content=60.7%

Type III

Polyorganosiloxane of general formula (1), wherein $R_1$ is —OH, $R_3$ is —$CH_2CH_2CH_2N(H)(CH_2CH_2NH_2)$, X+Y=300–1500, % nitrogen (with respect to silicone)=0.03

3.6% of an emulsifier

14% of an emulsifiable oxidised polyethylene which has a density of 0.95 to 1.05 g/cm$^3$ at 20° C., a drop point of 100–150° C., an acid number of 10 to 60 and a saponification number of 15 to 80 solid content of the emulsion measured by evaporation at 120° C.=23.0–25.0% water content=73.7%

Type IV

Polyorganosiloxane of general formula (1), wherein $R_1$ is —OH, $R_3$ is —$CH_2CH_2CH_2N(H)(CH_2CH_2NH_2)$, X+Y=300–1500, % nitrogen (with respect to silicone)=0.11

4.3% of an emulsifier 0.3% of a fatty acid monoalkanolamide of formula (15b), wherein $R_{34}$ is hydrogen and $R_{37}$ is hydrogen or a radical of formula —$C(O)R_{36}$ solid content of the emulsion measured by evaporation at 120° C.=37.0–39.0% water content=60.7%

Type V

Polyorganosiloxane of general formula (1), wherein $R_1$ is —OH, $R_3$ is $—CH_2CH_2CH_2N(H)(CH_2CH_2NH_2)$, X+Y=300–1500, % nitrogen (with respect to silicone)=0.11

4.4% of an emulsifier 0.2% of an emulsifiable oxidised polyethylene which has a density of 0.95 to 1.05 g/cm$^3$ at 20° C., a drop point of 100–150° C., an acid number of 10 to 60 and a saponification number of 15 to 80 solid content of the emulsion measured by evaporation at 120° C.=37.0–39.0% water content=60.7%

Type VI

Polyorganosiloxane of general formula (1), wherein $R_1$ is $—CH_3$, $R_3$ is $—CH_2CH_2CH_2N(H)(CH_2CH_2NH_2)$, X+Y=150–300, % nitrogen (with respect to silicone)=0.12

11% of an emulsifier 0.3% of a fatty acid dialkanolamide of formula (15a), wherein $R_{34}$, $R_{38}$, $R_{38}'$ and $R_{38}''$ are hydrogen or $—CH_2OH$ solid content of the emulsion measured by evaporation at 120° C.=24.0–26.0% water content=72.1%

Type VII

Polyorganosiloxane of general formula (1), wherein $R_1$ is $—CH_3$, $R_3$ is $—CH_2CH_2CH_2N(H)(CH_2CH_2NH_2)$, X+Y=40–150, % nitrogen (with respect to silicone)=0.08

13.2% of an emulsifier 0.23% of an emulsifiable oxidised polyethylene which has a density of 0.95 to 1.05 g/cm$^3$ at 20° C., a drop point of 100–150° C., an acid number of 10 to 60 and a saponification number of 15 to 80 solid content of the emulsion measured by evaporation at 120° C.=41.0–43.0% water content=44.4%

Type VIII

Polyorganosiloxane of general formula (1), wherein $R_1$ is $—CH_3$, $R_3$ is $—CH_2CH_2CH_2N(H)(CH_2CH_2N(H)((CO)(CH_2CH_2CH_2OH)))$, X+Y=300–1500, % nitrogen (with respect to silicone)=0.1

9.8% of an emulsifier 0.1% of an emulsifiable oxidised polyethylene which has a density of 0.95 to 1.05 g/cm$^3$ at 20° C., a drop point of 100–150° C., an acid number of 10 to 60 and a saponification number of 15 to 80 solid content of the emulsion measured by evaporation at 120° C.=20.5–22.5% water content=76.9%

Type IX

Polyorganosiloxane of general formula (8), wherein $R_{17}$ is $—CH_3$, $R_3$ is $CH_3$, $R_{19}$ is a polyethylenoxide radical, $X^1+Y^1+S$=40–150, % nitrogen (with respect to silicone)=0

2% of an emulsifier 0.15% of an emulsifiable oxidised polyethylene which has a density of 0.95 to 1.05 g/cm$^3$ at 20° C., a drop point of 100–150° C., an acid number of 10 to 60 and a saponification number of 15 to 80 solid content of the emulsion measured by evaporation at 120° C.=23.0–25.0% water content=74.9%

Type X

Polyorganosiloxane of general formula (8), wherein $R_{17}$ is $—CH_3$, $R_3$ is $—CH_2CH_2CH_2NH_2$, $R_{19}$ is a polyethylene/polypropyleneoxide radical, $X^1+Y^1+S$=150–300 % nitrogen (with respect to silicone)=0.07

3.5% of an emulsifier 1.5% of a fatty acid dialkanolamide of formula (15*a*), wherein $R_{34}$, $R_{38}$, $R_{38}'$ and $R_{38}''$ are hydrogen or $—CH_2OH$ solid content of the emulsion measured by evaporation at 120° C.=19.5–21.5% water content=73%

Type XI

Polyorganosiloxane of general formula (9), wherein $R_{26}$ is $C_{12}$alkyl, $R_{27}$ is 2-phenylpropyl, $R_{28}$ is an epoxy radical of formula (10), $X^2+X^3+X^4+Y^2$=40–150, % nitrogen (with respect to silicone)=0

2.9% of an emulsifier 0.85% of an emulsifiable oxidised polyethylene which has a density of 0.95 to 1.05 g/cm$^3$ at 20° C., a drop point of 100–150° C., an acid number of 10 to 60 and a saponification number of 15 to 80 solid content of the emulsion measured by evaporation at 120° C.=37.0–39.0% water content=62%

Type XII

Polyorganosiloxane of general formula (1), wherein $R_1$ is $CH_3$, $R_3$ is $C_{18}$alkoxy, X+Y=40–150, % nitrogen (with respect to silicone)=0

3.2% of an emulsifier 1.5% of an emulsifiable oxidised polyethylene which has a density of 0.95 to 1.05 g/cm$^3$ at 20° C., a drop point of 100–150° C., an acid number of 10 to 60 and a saponification number of 15 to 80 solid content of the emulsion measured by evaporation at 120° C.=34.0–35.5% water content=61.4%

Type XIII

Polyorganosiloxane of general formula (1), wherein $R_1$ is —OH, $R_3$ is $—CH_2CH_2CH_2N(H)(CH_2CH_2NH_2)$, X+Y=300–1500, % nitrogen (with respect to silicone)=0.1

4.2% of an emulsifier 6.2% of a fatty acid monoalkanolamide of formula (15b), wherein $R_{34}$ is hydrogen and $R_{37}$ is hydrogen or a radical of formula $—C(O)R_{36}$ solid content of the emulsion measured by evaporation at 120° C.=38–40% water content=60%

Type XIV

Polyorganosiloxane of general formula (8), wherein $R_3$ is $—CH_3$ and $R_{17}$ is $—CH_2CH_2CH_2NH_2$, $R_{19}$ is a polyethyleneoxide radical, $X^1+Y^1+S$=40–150, % nitrogen (with respect to silicone)=0.04

7.2% of an emulsifier solid content of the emulsion measured by evaporation at 120° C.=54–56% water content=38.1%

Type XV 1 part of emulsion Type XIII and 9 parts of emulsion type XIV

EXAMPLE 2

Hydrophilicity

The formulated rinse conditioners (see Table 1) are applied according to the following procedure:

Woven cotton swatches of size of 50 cm by 40 cm are washed together with ballast material (cotton and cotton/polyester) in a AEG Oeko Lavamat 73729 washing machine maintaining the washing temperature at 40° C. The total fabric load of 1 kg is washed for 15 minutes with 33 g of ECE Color Fastness Test Detergent 77 (Formulation January 1977, according to ISO 105-CO6). The rinse conditioner formulation as described in Table 1 is applied in the last rinse cycle at 20° C. After rinsing with the formulation the textile swatches are dried on a washing line at ambient temperature.

Evaluation of Hydrophilicity

The water absorption of fabrics treated with the test samples is measured by the wicking test. Test strips are fixed to a frame and dipped about 1 mm deep in a colored aqueous solution. The rise of water in the strips is measured after twenty minutes. Water absorption of fabrics treated with rinse conditioner formulations from Table 1 are compared. The average values of four parallel measurements are given in Table 2.

TABLE 2

| Rinse conditioner sample | Measured water rinse (cm) |
|---|---|
| 0 (Reference) | 8.2 |
| A | 9.6 |
| B | 10.2 |
| C | 9.5 |
| D | 9.6 |
| E | 9.2 |
| F | 9.0 |
| G | 9.8 |
| H | 9.1 |
| I | 9.2 |
| J | 9.6 |
| K | 9.8 |
| L | 9.6 |
| M | 9.3 |

These results show an improved hydrophilicity of the textile fabric material treated with compositions of the present invention.

In all experiments the following textiles have been used:

Cotton woven: 120 g/m2, bleached, with resin finishing:

Cotton/Polyester 66/34 woven: 85 g/m2, bleached.

Both textiles were finished with a resin according to Oekotex Standard 100:

30 g/l of modified dimethyloldihydroxyethylene urea (70% active material)

9 g/l Magnesiumchloride (with 6 $H_2O$)

padding with a pick-up of approximately 80%

Drying at about 110–120° C. in a oven followed by a 4 minute curing step at 145° C.

What is claimed is:

1. A method of use of a liquid aqueous softener composition for imparting hydrophilicity to textile fibre materials in domestic applications, which comprises treating textile fibre materials during textile laundering with a softener composition which comprises:

A) a fabric softener;

B) at least one additive selected from the group consisting of b) a fatty acid alkanolamide of formula

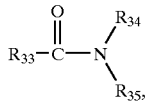

(14)

wherein $R_{33}$ is a saturated or unsaturated hydrocarbon radical containing 10 to 24 carbon atoms, $R_{34}$ is hydrogen or a radical of formula —$CH_2OH$, —$(CH_2CH_2O)_cH$ or

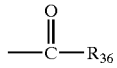

wherein c is a number from 1 to 10 and $R_{36}$ is as defined above for $R_{33}$, and $R_{35}$ is a radical of formula

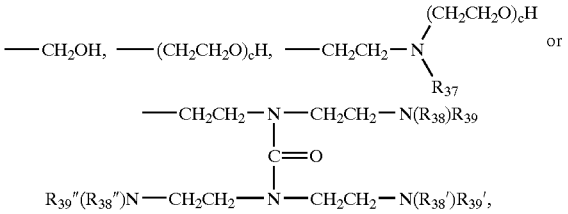

and c is as defined above, $R_{37}$ is hydrogen or a radical of formula

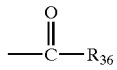

wherein $R_{36}$ is as defined above, $R_{38}$, $R_{38}'$ and $R_{38}''$ have the same or different meaning and are as defined above for $R_{34}$, and $R_{39}$, $R_{39}'$ and $R_{39}''$ have the same or different meaning and are a radical of formula

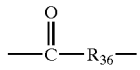

wherein $R_{36}$ is as defined above, or a mixture thereof, and

C) a dispersed polyorganosiloxane of formula (1)

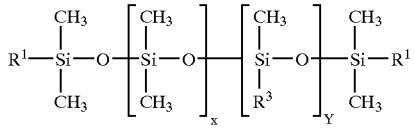

(1)

wherein $R^1$ is OH, $OR^2$ or $CH_3$ $R^2$ is $CH_3$ or $CH_2CH_3$ $R^3$ is $C_1$–$C_{20}$alkoxy, $CH_3$, $CH_2CHR^4CH_2NHR^5$, or $CH_2CHR^4CH_2N(COCH_3)R^5$ (2)

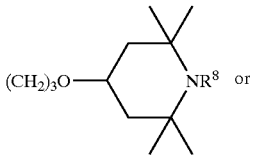

(3)

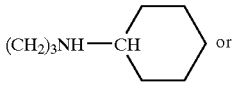

(4)

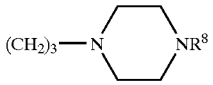

$R^4$ is H or $CH_3$ $R^5$ is H, $CH_2CH_2NHR^6$, C(=O)—$R^7$ or $(CH_2)_z$—$CH_3$ z is 0 to 7

$R^6$ is H or C(=O)—$R^7$ $R^7$ is $CH_3$, $CH_2CH_3$ or $CH_2CH_2CH_2OH$ $R^8$ is H or $CH_3$ the sum of X and Y is 40 to 4000;

or a dispersed polyorganosiloxane which comprises at least one unit of the formula (5)

$$(R^9)_v(R^{10})_w\text{Si—A—B} \quad (5)$$

wherein $R^9$ is $CH_3$, $CH_3CH_2$ or Phenyl $R^{10}$ is —O—Si or —O—$R^9$ the sum of v and w equals 3, and v does not equal 3

A=—$CH_2CH(R^{11})(CH_2)_K$

B=—$NR^{12}((CH_2)_l$—$NH)_mR^{12}$, or (6)

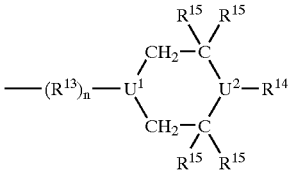

n is 0 or 1 when n is 0, $U^1$ is N, when n is 1, $U^1$ is CH l is 2 to 8 k is 0 to 6 m is 0 to 3

$R^{11}$ is H or $CH_3$ $R^{12}$ is H, C(=O)—$R^{16}$, $CH_2(CH_2)_pCH_3$ or (7)

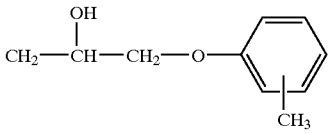

p is 0 to 6

$R^{13}$ is NH, O, $OCH_2CH(OH)CH_2N$(Butyl), OOCN(Butyl)

$R^{14}$ is H, linear or branched $C_1$–$C_4$ alkyl, Phenyl or $CH_2CH(OH)CH_3$ $R^{15}$ is H or linear or branched $C_1$–$C_4$ alkyl $R^{16}$ is $CH_3$, $CH_2CH_3$ or $(CH_2)_qOH$ q is 1 to 6

$U^2$ is N or CH;

or a dispersed polyorganosiloxane of the formula (8)

(8)

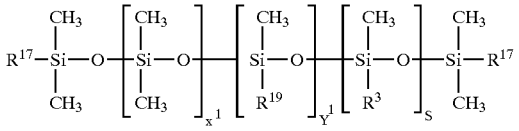

wherein $R^3$ is as previously defined $R^{17}$ is OH, $OR^{18}$ or $CH_3$ $R^{18}$ is $CH_3$ or $CH_2CH_3$ $R^{19}$ is $R^{20}$—$(EO)_m$—$(PO)_n$—$R^{21}$ m is 3 to 25 n is 0 to 10

$R^{20}$ is the direct bond or $CH_2CH(R^{22})(CH_2)_pR^{23}$ p is 1 to 4

$R^{21}$ is H, $R^{24}$, $CH_2CH(R^{22})NH_2$ or $CH(R^{22})CH_2NH_2$ $R^{22}$ is H or $CH_3$ $R^{23}$ is O or NH $R^{24}$ is linear or branched $C_1$–$C_8$ alkyl or $Si(R^{25})_3$ $R^{25}$ is $R^{24}$, $OCH_3$ or $OCH_2CH_3$ EO is —$CH_2CH_2O$—

PO is —$CH(CH_3)CH_2O$— or —$CH_2CH(CH_3)O$— the sum of $X_1$, $Y_1$ and S is 20 to 1500;

or a dispersed polyorganosiloxane of the formula (9)

(9)

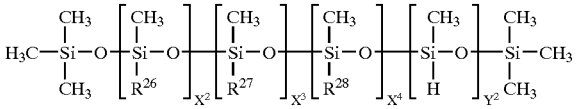

wherein $R^{26}$ is linear or branched $C_1$–$C_{20}$ alkoxy, $CH_2CH(R^4)R^{29}$ $R^4$ is as previously defined $R^{29}$ is linear or branched $C_1$–$C_{20}$ alkyl $R^{27}$ is aryl, aryl substituted by linear or branched $C_1$–$C_{10}$ alkyl, linear or branched $C_1$–$C_{20}$ alkyl substituted by aryl or aryl substituted by linear or branched $C_1$–$C_{10}$ alkyl $R^{28}$ is (10)

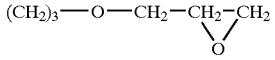

the sum of $X^2$, $X^3$, $X^4$ and $Y^2$ is 20 to 1500, wherein $X^3$, $X^4$ and $Y^2$ may be independently of each other 0;

or a mixture thereof.

2. A method of use according to claim 1 wherein the polyorganosiloxane is of formula (1):

(1)

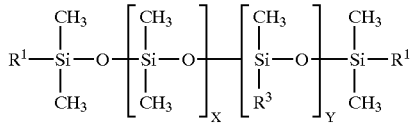

wherein $R^1$ is OH, $OR^2$ or $CH_3$ $R^2$ is $CH_3$ or $CH_2CH_3$ $R^3$ is $C_1$–$C_{20}$alkoxy, $CH_3$, $CH_2CHR^4CH_2NHR^5$, or (2)

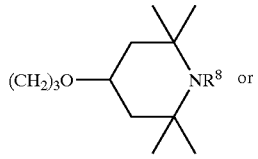

(3)

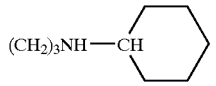

$R^4$ is H or $CH_3$ $R^5$ is H, $CH_2CH_2NHR^6$, C(═O)—$R^7$ $R^6$ is H or C(═O)—$R^7$ $R^7$ is $CH_3$, $CH_2CH_3$ or $CH_2CH_2CH_2OH$ $R^8$ is H or $CH_3$ the sum of X and Y is 40 to 4000;

or a dispersed polyorganosiloxane which comprises at least one unit of the formula (5);

$$(R^9)_v(R^{10})_w\text{Si—A—B} \quad (5)$$

wherein $R^9$ is $CH_3$, $CH_3CH_2$ $R^{10}$ is —O—Si or —O—$R^9$ the sum of v and w equals 3, and v does not equal 3

A=—$CH_2CH(R^{11})(CH_2)_k$

B=

(6)

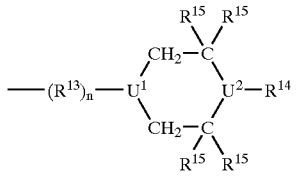

n is 1

$U^1$ is CH k is 0 to 6

$R^{11}$ is H or $CH_3$ $R^{13}$ is OOCN(Butyl)

$R^{14}$ is H, linear $C_1$–$C_4$ alkyl, Phenyl $R^{15}$ is H or linear $C_1$–$C_4$ alkyl $U^2$ is N;

or a dispersed polyorganosiloxane of the formula (8);

(8)

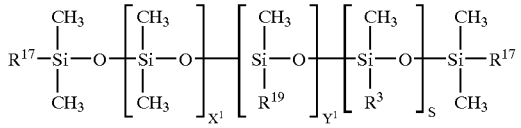

wherein $R^3$ is as previously defined $R^{17}$ is OH, $OR^{18}$ or $CH_3$ $R^{18}$ is $CH_3$ or $CH_2CH_3$ $R^{19}$ is $R^{20}$—$(EO)_m$—$(PO)_n$—$R^{21}$ m is 3 to 25 n is 0 to 10

$R^{20}$ is the direct bond or $CH_2CH(R^{22})(CH_2)_pR^{23}$ p is 1 to 4

$R^{21}$ is H, $R^{24}$, $CH_2CH(R^{22})NH_2$ or $CH(R^{22})CH_2NH_2$ $R^{22}$ is H or $CH_3$ $R^{23}$ is O or NH $R^{24}$ is linear or branched $C_1$–$C_3$ alkyl or $Si(R^{25})_3$ $R^{25}$ is $R^{24}$, $OCH_3$ or $OCH_2CH_3$ EO is —$CH_2CH_2O$—

PO is —$CH(CH_3)CH_2O$— or —$CH_2CH(CH_3)O$— the sum of $X_1$, $Y_1$ and s is 20 to 1500;

or a dispersed polyorganosiloxane of the formula (9);

(9)

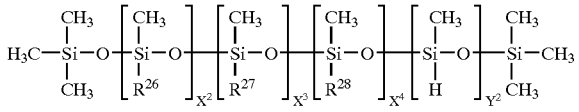

wherein $R^{26}$ is linear $C_1$–$C_{20}$ alkoxy, $R^4$ is as previously defined $R^{29}$ is linear $C_1$–$C_{20}$ alkyl $R^{27}$ is, $CH_2CH(R^4)$Phenyl $R^{28}$ is (10)

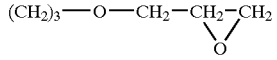

the sum of $X^2$, $X^3$, $X^4$ and $Y^2$ is 20 to 1500, wherein $X^3$, $X^4$ and $Y^2$ may be independently of each other 0;

or a mixture thereof.

3. A method of use according to claim 1 wherein a polyorganosiloxane of formula (1) is used, wherein $R^1$ is OH or $CH_3$, $R^3$ is $CH_3$, $C_{10}$–$C_{20}$alkoxy or $CH_2CHR^4CH_2NHR^5$, $R^4$ is H, $R^5$ is H or $CH_2CH_2NHR^6$, $R^6$ is H or C(═O)—$R^7$, and $R^7$ is $CH_3$, $CH_2CH_3$ or $CH_2CH_2CH_2OH$.

4. A method of use according to claim 1 wherein a polyorganosiloxane of formula (8) is used, wherein $R^3$ is $CH_3$, $C_{10}$–$C_{20}$alkoxy or $CH_2CHR^4CH_2NHR^5$, $R^4$ is H, $R^5$ is H or $CH_2CH_2NHR^6$, $R^6$ is H or C(=O)—$R^7$, $R^7$ is $CH_2CH_3$, $CH_2CH_2CH_2OH$ or especially $CH_3$, and $R_{17}$ is $CH_3$ or OH.

5. A method of use according to claim 1 wherein a polyorganosiloxane of formula (9) is used, wherein $R^{26}$ is $CH_2CH(R^4)R^{29}$, $R^4$ is H, and $R^{27}$ is 2-phenyl propyl.

6. A method of use according to claim 1 in which the polyorganosiloxane is nonionic or cationic.

7. A method of use according to claim 1 in which the composition has a solids content of 5 to 70% at a temperature of 120° C.

8. A method of use according to claim 1 in which the composition contains a water content of 25 to 90% by weight based on the total weight of the composition.

9. A method of use according to claim 1 in which the composition has a pH value from 2 to 7.

10. A method of use according to claim 1 in which the nitrogen content of the aqueous emulsion due to the poly organosiloxane is from 0 to 0.25% with respect to the silicon content.

11. A method of use according to claim 1 wherein the composition is prepared by mixing a preformulated fabric softener with an emulsion comprising the polyorganosiloxane and the additive.

12. A method of use according to claim 1 wherein the composition has a clear appearance.

13. A method of use according to claim 1 in which the composition comprises:

a) 0.01 to 70% by weight, based on the total weight of the composition, of a polyorganosiloxane, or a mixture thereof;

b) 0.2 to 15% by weight based on the total weight of an emulsifier, or a mixture thereof;

c) 0.01 to 15% by weight based on the total weight of at least one fatty acid alkanolamide of formula (14) as defined in claim 1, and d) water to 100%.

* * * * *